US006042127A

United States Patent [19]

Rupolo

[11] Patent Number: 6,042,127

[45] Date of Patent: Mar. 28, 2000

[54] COMBINATION UTILITY BAG AND CARRIAGE APPARATUS

[76] Inventor: Antonio M. Rupolo, 1236 Hammond Street, Burlington, Ontario, Canada, L7S 2E1

[21] Appl. No.: 09/133,454

[22] Filed: Aug. 13, 1998

[51] Int. Cl.[7] ..... B62D 39/00

[52] U.S. Cl. ..... 280/33.998; 280/651; 280/655.1; 280/79.2

[58] Field of Search ..... 280/30, 651, 655, 280/35, 37, 655.1, 639, 659, 43.1, 43, 43.17, 43.24, 43.34, 43.35, 43.371, 79.11, 79.2, 79.3, 79.7

[56] References Cited

U.S. PATENT DOCUMENTS

| | | | |
|---|---|---|---|
| 2,596,578 | 5/1952 | McIntyre | 280/38 |
| 2,903,270 | 9/1959 | Ross | 280/37 |
| 2,961,250 | 11/1960 | Beach | 280/35 |
| 3,178,197 | 4/1965 | Boatner | 280/37 |
| 3,661,414 | 5/1972 | Roth | 294/59 |
| 3,841,650 | 10/1974 | Miskelly | 280/37 |
| 3,850,442 | 11/1974 | Wehner | 280/47.371 |
| 4,796,909 | 1/1989 | Kirkendall | 280/651 |
| 5,227,449 | 7/1993 | Schmidt | 280/655 |
| 5,465,996 | 11/1995 | Wisz | 280/651 |
| 5,826,893 | 10/1998 | Snoeyenbos | 280/43 |
| 5,930,915 | 8/1999 | Dhaemers | 34/511 |
| 5,931,120 | 8/1999 | Burns et al. | 119/497 |

*Primary Examiner*—Paul N. Dickson
*Assistant Examiner*—Bridget Avery

[57] ABSTRACT

A new combination utility bag and carriage apparatus for transporting items therein. The inventive device includes a utility bag and a carriage. The utility bag has an interior, top and bottom panels, a pair of end panels and a pair of side panels. The top panel has an elongate top slit into the interior of the utility bag. Coupled to each side panel is a side handle. One of the side panels has a pair of skate sleeves coupled thereto. The bottom panel has a pair of spaced apart elongate rail ridges. The carriage has top and bottom surfaces, first and second ends, and a pair of sides extending between the ends of the carriage. The carriage has a plurality of ground engaging wheels rotatably mounted thereto and the bottom surface of the carriage has a plurality of elongate skids. The bottom panel of the utility bag is restable on the top surface of the carriage. The top surface of the carriage has a pair of spaced apart elongate track channels which the rail ridges of the bottom panel of the utility bag are slidably insertable into when the bottom panel of the utility bag is rested on the top surface. The track channels and the rail ridges have cooperating transverse cross sections so that the utility bag can only be removed from the carriage by endwise sliding thereon. The carriage also has a handle pivotally mounted to the carriage.

17 Claims, 2 Drawing Sheets

COMBINATION UTILITY BAG AND CARRIAGE APPARATUS

BACKGROUND OF THE INVENTION

1. Field of the Invention

The present invention relates to utility bags and more particularly pertains to a new combination of a utility bag and a wheeled carriage therefor.

2. Description of the Prior Art

Wheeled utility bags are is known in the prior art. More specifically, wheeled utility bags heretofore devised and utilized consist basically of familiar, expected and obvious structural configurations, notwithstanding the myriad of designs encompassed by the crowded prior art which have been developed for the fulfillment of countless objectives and requirements.

Pior art wheeled utility bags are shown in U.S. Pat. No. 5,407,039; U.S. Pat. No. 5,307,908; U.S. Pat. No. 5,209,328; and U.S. Pat. No. 3,236,538.

While these devices fulfill their respective, particular objectives and requirements, the aforementioned patents do not disclose a combination comprising a utility bag and a carriage therefor The combination utility bag and carriage according to the present invention substantially departs from the conventional concepts and designs of the prior art.

SUMMARY OF THE INVENTION

The present invention provides a new and inventive combination comprising a utility bag and a separable carriage therefor.

The general purpose of the present invention, which will be described subsequently in greater detail, is to provide a new combination of a utility bag and a carriage therefor which has many of the advantages of the wheeled utility bags mentioned heretofore and many novel and inventive features that result in a new combination utility bag and carriage which is not anticipated, rendered obvious, suggested, or even implied by any of the prior art wheeled utility bags, either alone or in any combination thereof.

To attain this, the present invention generally comprises a utility bag and a carriage therefor and separable therefrom. The utility bag has an interior, top and bottom panels, a pair of end panels and a pair of side panels. The top panel has an elongate top opening into the interior of the utility bag. A side handle is attached to each side panel. One of the side panels has a pair of skate sleeves attached thereto. The bottom panel preferably has a pair of spaced apart elongate rail ridges. The carriage has top and bottom surfaces, first and second ends, and a pair of sides extending between the ends. The carriage has a plurality of ground engaging wheels rotatably mounted thereto and the bottom surface of the carriage has a plurality of elongate skids. In combination the bottom panel of the utility bag rests on the top surface of the carriage. The top surface of the carriage has a pair of spaced apart elongate track channels into which the rail ridges of the bottom panel of the utility bag are slidably insertable so that the bottom panel of the utility bag rests on the top surface. Preferably the rail ridges and the track channels are of complementary cooperating cross sections such that the utility bag cannot be lifted off the carriage without relative longitudinal sliding movement between them. The carriage also has a handle pivotally mounted thereon.

There has thus been outlined, rather broadly, the more important features of the invention in order that the detailed description thereof that follows may be better understood, and in order that the present contribution to the art may be better appreciated. Additional features of the invention will be described hereinafter.

In this respect, before explaining at least one embodiment of the invention in detail, it is to be understood that the invention is not limited in its application to the specific details of construction and to the specific arrangements of the components set forth in the following description and/or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is determined by the claims, nor is it intended to be limiting as to the scope of the invention in any way.

It is therefore an object of the present invention to provide a new inventive combination of a utility bag and a carriage therefor. It is another object to provide such a combination which has many of the advantages of the wheeled utility bags mentioned heretofore and many novel and inventive features that result in a new combination of utility bag and carriage which is not anticipated, rendered obvious, suggested, or even implied by any of the prior art wheeled utility bags, either alone or in any combination thereof.

A further object to provide a new combination of utility bag and carriage thereof which may be easily and efficiently manufactured and marketed.

It is a further object to provide a new combination of utility bag and carriage therefor which is of a durable and reliable construction.

An even further object to provide a new combination of utility bag and carriage therefor which is susceptible of a low cost of manufacture with regard to both materials and labor, and which accordingly is then susceptible of low prices of sale to the consuming public, thereby making such combination utility bag and carriage apparatus economically available to the buying public.

Still yet another object of the present invention is to provide a new combination of utility bag and carriage therefor that allows easy transport of skating equipment, especially hockey equipment.

Even still another object of the present invention is to provide a new and inventive combination of utility bag and carriage therefor that lets users roll the utility bag along on the ground, which is especially convenient when transporting heavy items therein.

These together with other objects of the invention, along with the various inventive features which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood when consideration is given to the following detailed description thereof. Such description makes reference to the annexed drawings wherein.

DESCRIPTION OF THE PREFERRED EMBODIMENT

Figure 1:
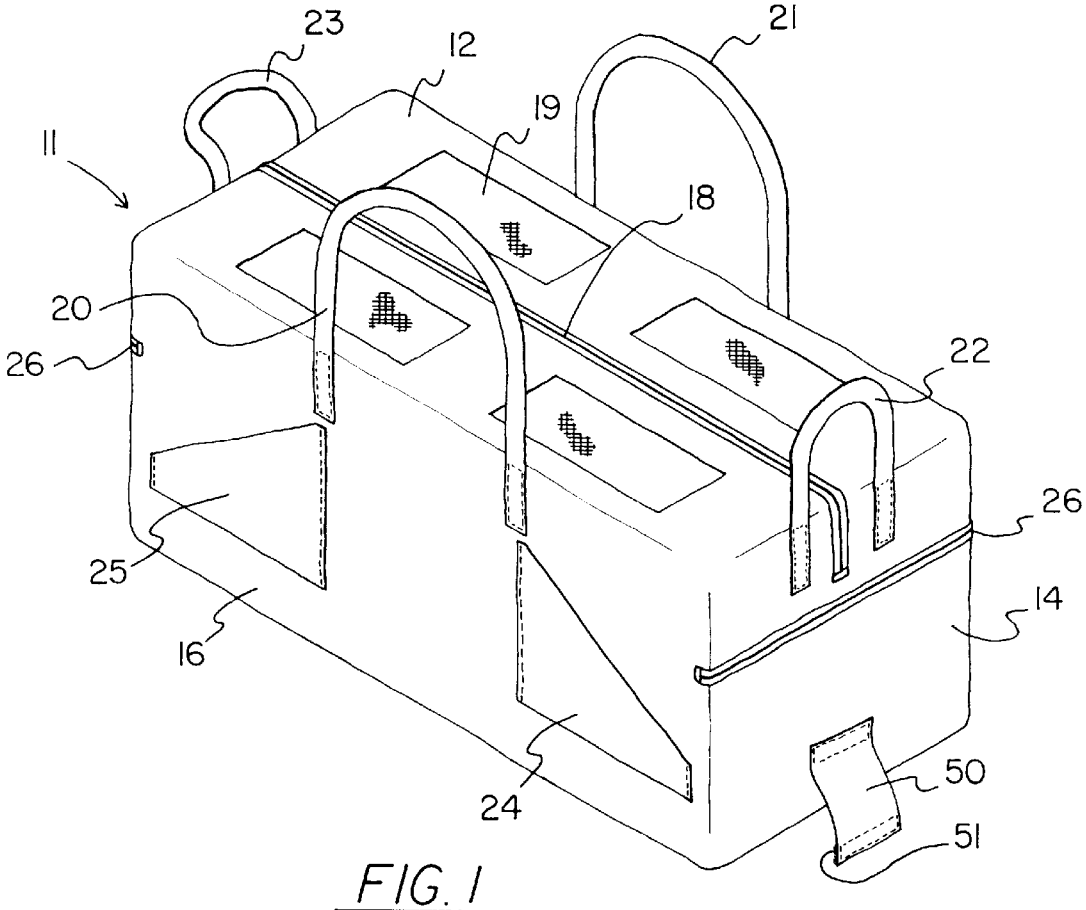
FIG. 1 is a schematic perspective view of a utility bag comprising one component of a new combination of a utility bag and carriage therefor according to the present invention.

As illustrated in FIGS. 1 through 6, the combination utility bag and carriage apparatus generally comprises a utility bag 11 and a carriage 30. The utility bag 11 has an interior, top and bottom panels 12,13, a pair of end panels 14,15 and a pair of side panels 16,17. The top panel 12 has an elongate top opening 18 into the interior of the utility bag 11. Attached to each side panel 16,17 is a side handle 20,21. One of the side panels 16 has a pair of skate sleeves 24,25 coupled thereto. The bottom panel 13 has a pair of spaced parallel apart elongate rail ridges 27,28. The carriage 30 has top and bottom surfaces 31,32, first and second ends, and a pair of sides extending between the ends. The carriage 30 has a plurality of ground engaging wheels 37 rotatably mounted thereto and the bottom surface 32 has a plurality of elongate parallel skids 40,41,42. The bottom panel 13 of the utility bag 11 rests on the top surface 31 of the carriage 30. The top surface 31 of the carriage 30 has a pair of spaced apart elongate parallel track channels 43,44 into which the rail ridges 27,28 of the bottom panel 13 of the utility bag 11 are slidably insertable when the bottom panel 13 of the utility bag 11 is rested on the top surface 31. The carriage 30 also has a handle 48 pivotally mounted to the carriage 30.

Figure 3:
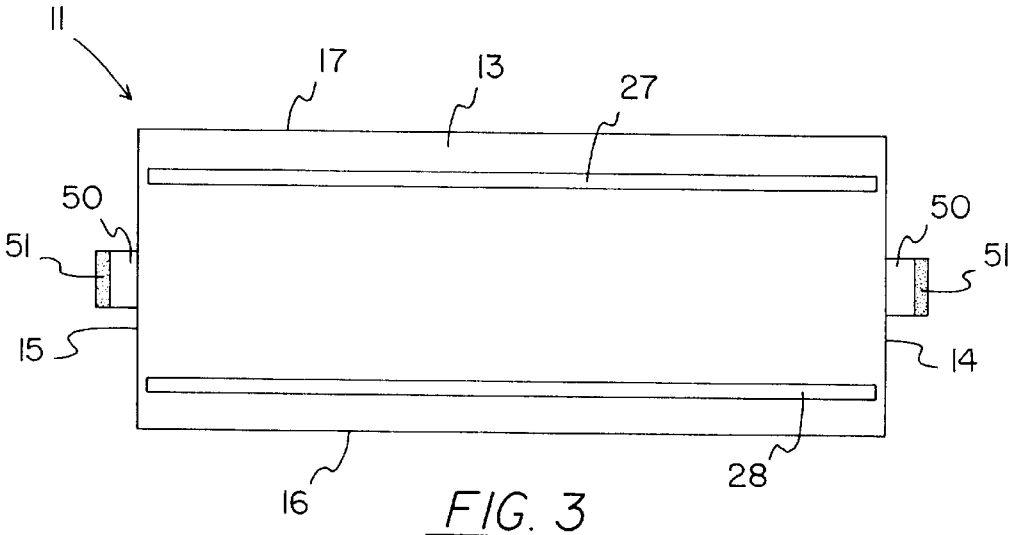
FIG. 3 is a schematic bottom side view of the utility bag of FIG. 1.

In more detail, with reference to FIGS. 1 and 3, the utility bag 11 is preferably generally rectangular such that all of the panels are generally rectangular. Ideally, the panels of the utility bag 11 comprise a flexible material such as a nylon material. The top opening 18 is designed to permit insertion of items and equipment into the interior of the utility bag 11 and removal therefor. The opening 18 extends between the end panels 14,15, preferably so that it is generally parallel with the side panels 16,17. Ideally, a zipper closes the opening 18. The top panel 12 also has a plurality of spaced apart vented regions 19 designed to permit air to circulate into the interior space. Preferably, a pair of such vented regions are positioned to one side of the opening 18 and another pair are positioned on the other side of the opening. In a preferred embodiment, each of the vented regions 19 is generally rectangular and has a plurality of apertures therethrough into the interior of the utility bag 11, and ideally each of the vented regions 19 comprises a mesh material.

The utility bag 11 has a pair of U-shaped side handles 20,21 which are designed to permit carrying of the utility bag 11 by a user when it is separated from the carriage. The side handle 20 is coupled to the side panel 16 while the other side handle 21 is coupled to the other side panel 17. The side handles 20,21 preferably are positioned adjacent the top panel 12 so that they extend upward away from the top panel 12. The utility bag 11 also preferably includes a pair of U-shaped end handles 22,23 designed for helping a user lift and maneuver the utility bag 11, especially when sliding the utility bag on and off of the carriage 30. One of the end handles 22 is coupled to one of the end panels 14 and the other end handle 23 is coupled to the other end panel 15. Like the side handles, the end handles 22,23 are preferably positioned adjacent the top panel 12 so that they extend upward away from the top panel 12.

As shown in FIG. 1, at least one of the side panels 16 or 17 has a pair of generally triangular skate sleeves 24,25 coupled thereto. Each of the skate sleeves 24,25 has a top opening therein and is designed to receive a skate therein so as to hold the skate on the utility bag 11 for easy transport of the skate while permitting easy access to the skate and its removal from the sleeve. Preferably, each of the end panels 14,15 has an end pocket 26 therein. The end pockets 26 are designed for holding items such as hockey pucks and other small accessories therein. Ideally, each of the end panels has a zipper closing its associated end pocket.

As illustrated in FIG. 3, the utility bag bottom panel 13 has a pair of spaced apart elongate rail ridges 27,28, the lengths of the rail ridges 27,28 being such that they extend between the end panels 14,15, preferably generally parallel to each other.

Figure 4:
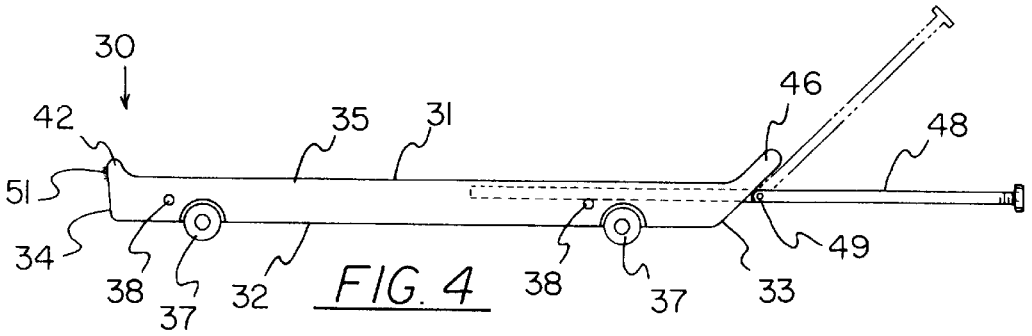
FIG. 4 is a schematic side view of the carriage of FIG. 2 illustrating the deployment of the handle.
Figure 5:
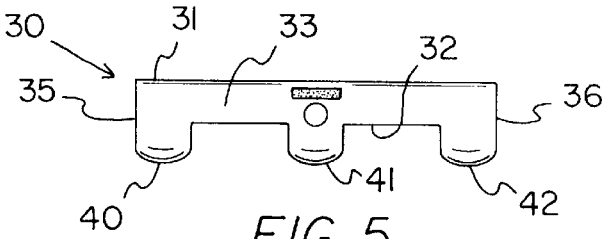
FIG. 5 is a schematic end view of the carriage of FIGS. 2 and 4 and showing also a lower portion of the utility bag.
Figure 6:
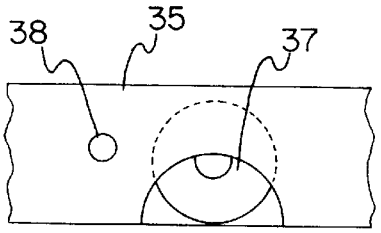
FIG. 6 is a schematic partial side view of a retractable wheel of the carriage.

With reference to FIGS. 2, 4, 5, and 6, the carriage 30, which preferably is molded from a suitable plastics material, is designed for transporting the utility bag 11 on a ground surface. The carriage 30 has generally rectangular top and bottom surfaces 31,32, first and second ends 33,34, and a pair of sides 35,36 extending between the ends 33,34. The carriage 30 has a plurality of ground engaging wheels 37 rotatably mounted thereto on which the carriage is rolled over the ground surface. Preferably, a first pair of the wheels is positioned adjacent the carriage side 35 and a second pair of the wheels is positioned adjacent the side 36. As shown in FIG. 6, preferably the wheels 37 are selectively retractable into the carriage 30 when they are not in use so that the carriage 30 does not accidentally roll away from the user when the user has rested the carriage 30 at a location. Ideally, each of the wheels 37 has a quick release button 38 provided on the associated side of the carriage 30 for extending the wheel from retracted position to a ground engageable deployed position.

As illustrated in FIG. 5, the bottom surface 32 of the carriage 30 has a plurality of elongate parallel rounded skids 40,41,42 of lengths such that they extend between the ends 33,34 of the carriage 30. The skids 40,41,42 are designed for aiding the pulling of the carriage 30 over snow and ice and other ground surfaces when this would be easier than rolling on the wheels 37. Preferably, a respective skid 40,42 is positioned adjacent each side 35,36 of the carriage 30 and another skid 41 is positioned along the center of the carriage 30 between the other two skids 40,42. In use, the bottom panel 13 of the utility bag 11 rests on the top surface 31 of the carriage 30 to permit transportation of the utility bag 11 on the carriage 30. However, when the user has reached a location at which the contents of the utility bag are to be taken from and returned to the bag interior the bag can be removed from the carriage for more ready handling thereof.

Figure 2:
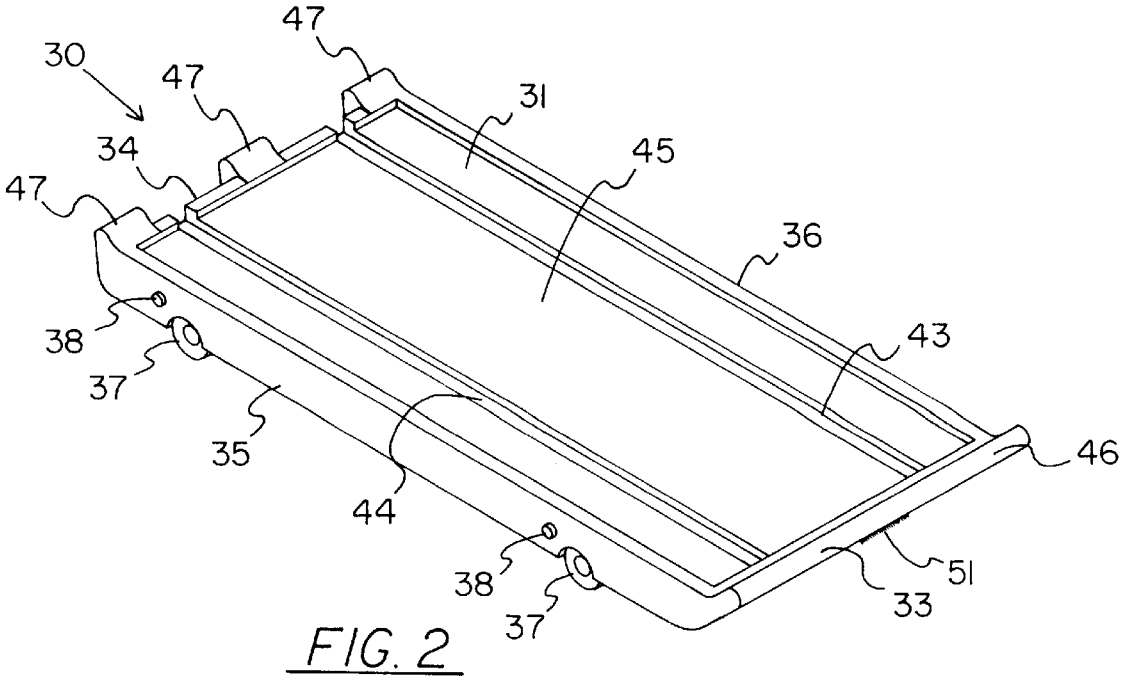
FIG. 2 is a schematic perspective view of a carriage comprising the other component of the combination.

As depicted in FIG. 2, the top surface 31 of the carriage 30 has formed therein a pair of spaced apart elongate track channels 43,44, the lengths of the track channels being such that they extend from the first end 33 of the carriage 30 towards the second end 34 of the carriage 30 while stopping just short of the end 34. The track channels 43,44 extend generally parallel to each other and in use, the rail ridges 27,28 of the bottom panel 13 of the utility bag 11 are slidably insertable into the track channels 43,44 when the utility bag 11 is placed on the top surface 31 to help attach and hold the utility bag 11 to the carriage 30. To this end the rail ridges 27, 28 and the track channels 43, 44 have complementary cooperating transverse cross sections nesting one within the other, and such that they cannot be separated by upward lifting of the utility bag from the carriage, but only by endwise sliding of the rail ridges out of the track channels toward the carriage end 33. For example, as shown in FIGS. 2 and 5 the track channels are of truncated triangular transverse cross section with the truncated end upward, so that the mouths of the track channels opening at the top surface 31 are smaller in width than the bottom surfaces of the channels. As shown in FIG. 5 the rail ridges 27, 28 are also of truncated triangular transverse cross section with the side attached to the utility bag lower surface 13 narrower than its parallel surface.

The rail ridges are also able to act as skids on which the utility bag can be slid over a floor when it is too heavy to lift, without damage to the fabric of the bag. Alternatively the rail ridges and track channels can be of some other cooperating transverse cross section such as a keyhole or the segment of a circle subtending more than 180 degrees at its center alternatively, although not specifically illustrated, the rail ridges can be provided on the carriage while the track channels are provided on the utility bag. Although, as shown, two transversely spaced rail ridges and cooperating track channels are preferred the desired retention could be provided by a single rail ridge and a single cooperating track channel.

Ideally, the top surface 31 of the carriage 30 has a generally rectangular depression 45 with the track channels 43,44 located in the depression 45. The depression 45 also helps in holding the utility bag 11 securely on the carriage 30.

In the preferred embodiment, the first end 33 of the carriage 30 has an upwardly and outwardly extending flanged portion 46 aiding the pulling of the carriage 30 over snow. The flanged portion 46 has a first opening into one of the track channels 43 and a second opening into another of the track channels 44. These openings allow a user to slide the rail ridges 27,28 of the utility bag into and out of the track channels 43,44 from the first end 33 of the carriage. Even more preferably, the second end 34 of the carriage 30 has a plurality of upwardly and outwardly extending end flanges 47. Ideally, each of the end flanges 47 is positioned adjacent an associated skid 40,41,42 of the carriage 30.

As best illustrated in FIG. 4, the carriage 30 has a retractable handle 48 having a pair of ends. An inner end 49 of the handle 48 is slidably inserted into the first end 33 of the carriage 30 so that the handle 48 may be retracted into the carriage 30 when not in use and pulled out when needed. This inner end 49 is also pivotally mounted to the carriage 30 so that the handle 48 may be pivoted upwards when pulled out from the carriage 30, so that the other end of the handle 48 may be easily held at a comfortable height by a user when pulling carriage 30 with the handle 48.

Preferably, each of the utility bag end panels 14,15 has a respective attachment flap 50 fastened thereto. The flaps 50 being designed to secure the utility bag 11 to the carriage 30 against endwise movement thereon. In the preferred embodiment, the attachment flaps 50 are positioned towards the bottom panel 13. The attachment flaps 50 are detachably attachable to the carriage 30 when the bottom panel 13 of the utility bag 11 rests on the top surface 31 of the carriage 30. Ideally, a hook and loop fastener 51 detachably attaches each of the attachment flaps 50 to the carriage 30 when the bottom panel 13 rests on the top surface 31.

With respect to the above description, it is to be realized that the optimum dimensional relationships for the parts of the invention, including variations in size, materials, shape, form, function and manner of operation, assembly and use, are deemed readily apparent to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination of a utility bag and a carriage therefor, comprising:

a utility bag having an interior, top and bottom panels, a pair of end panels and a pair of side panels;

said top panel having an elongate opening into said interior of said utility bag;

said utility bag having a pair of side handles each extending from a respective one of said pair of side panels;

a carriage separable from said utility bag and having top and bottom surfaces, first and second ends, and a pair of sides extending between said ends of said carriage;

said carriage having a plurality of ground engaging wheels rotatably mounted thereto;

said bottom panel of said utility bag resting on said top surface of said carriage when the utility bag is in place on said carriage;

one of said utility bag bottom panel and said carriage top surface having at least one rail ridge thereon, and the other of said utility bag bottom panel and said carriage top surface having at least one elongate track channel therein, said rail ridge being slidably insertable into said track channel when said bottom panel of said utility bag rests on said carriage top surface; and said carriage having a handle having a pair of ends, one of said ends of said handle being pivotally mounted to said carriage.

2. The combination of claim 1 wherein there are provided a pair of spaced apart elongate track channels and a respective pair of rail ridges, each rail ridge being slidably insertable into its respective track channel.

3. The combination of claim 1, wherein the rail ridge and the track channel are of complementary cooperating transverse cross section preventing lifting of the utility bag from the carriage without relative sliding motion between them.

4. The combination of claim 1, wherein said top panel has a plurality of spaced apart vented regions, each having a plurality of apertures therethrough into the interior of said utility bag.

5. The combination of claim 1, wherein said utility bag has a pair of end handles, each end handle being coupled to a respective one of said end panels.

6. The combination of claim 1, wherein each of said end panels has a respective end pocket therein.

7. The combination of claim 1, wherein a first pair of said wheels is positioned adjacent one of said sides of said carriage, and a second pair of said wheels is positioned adjacent another side of said carriage.

8. The combination of claim 1, wherein said wheels are selectively retractable into said carriage.

9. The combination of claim 1, wherein said first end of said carriage has an upwardly and outwardly extending flanged portion.

10. The combination of claim 1, wherein said one of said ends of said handle is slidably inserted into said first end of said carriage.

11. The combination of claim 1, wherein each of said end panels has an attachment flap coupled thereto, and wherein said attachment flaps are detachably attachable to said carriage when said bottom panel of said utility bag rests on said top surface of said carriage.

12. The combination of claim 1, wherein at least one of said side panels has a pair of skate receiving sleeves attached thereto.

13. A combination as claimed in claim 1, wherein the bottom surface of the carriage has a pair of elongated parallel skids extending therefrom on which the combination can be slid over a surface.

14. The combination of claim 2, wherein the rail ridge and the track channel are of complementary cooperating transverse cross section preventing lifting of the utility bag from the carriage without relative sliding motion between them.

15. The combination of claim 1, wherein the top surface of the carriage has a depression between its ends in which the utility bag sits to assist in retention of the bag on the carriage.

16. The combination of claim 1, wherein the end of the carriage at which the handle is pivotally mounted has an upward extending portion to facilitate movement of the carriage over snow.

17. An apparatus, comprising:

a utility bag having an interior, top and bottom panels, a pair of end panels and a pair of side panels;

said top panel having an elongate top opening into said interior of said utility bag, said top opening being extended between said end panels, wherein a zipper closes said top opening;

said top panel having a plurality of spaced apart vented regions, each of said vented regions having a plurality of apertures therethrough into said interior of said utility bag, wherein each of said vented regions comprise a mesh material;

said utility bag having a pair of side handles, one of said side handles being coupled to one of said side panels, another of said side handles being coupled to another of said side panels, said side handles being positioned adjacent said top panel;

said utility bag having a pair of end handles, one of said end handles being coupled to one of said end panels, another of said end handles being coupled to another of said end panels, said end handles being positioned adjacent said top panel;

one of said side panels having a pair of skate sleeves coupled thereto, each of said skate sleeves being for receiving a skate therein;

each of said end panels having an end pocket therein, wherein each of said end panels has a zipper closing the associated end pocket;

said bottom panel having a pair of spaced apart elongate rail ridges, said rail ridges being extended between said end panels, said rail ridges being extended generally parallel to each other;

a carriage having top and bottom surfaces, first and second ends, and a pair of sides extending between said ends of said carriage;

said carriage having a plurality of ground engaging wheels rotatably mounted thereto, a first pair of said wheels being positioned adjacent one of said sides of said carriage, a second pair of said wheels being positioned adjacent another side of said carriage, said wheels being selectively retractable into said carriage;

said bottom surface of said carriage having a plurality of elongate skids, said skids being extended between said ends of said carriage;

said bottom panel of said utility bag being restable on said top surface of said carriage;

said top surface of said carriage having a pair of spaced apart elongate track channels, said track channels being extended from said first end of said carriage towards said second end of said carriage, said track channels being extended generally parallel to each other, said rail ridges of said bottom panel of said utility bag being slidably insertable into said track channel when said bottom panel of said utility bag is rested on said top surface;

said first end of said carriage having an upwardly and outwardly extending flanged portion, said flanged portion having a first opening into one of said track channels and a second opening into another of said track channels;

said carriage having a handle having a pair of ends, one of said ends of said handle being slidably inserted into said first end of said carriage, said one end of said handle being pivotally mounted to said carriage;

each of said end panels having an attachment flap coupled thereto, said attachment flaps being positioned towards said bottom panel; and said attachment flaps being detachably attachable to said carriage when said bottom panel of said utility bag is rested on said top surface of said carriage, wherein a hook and loop fastener detachably attaches each of said attachment flaps to said carriage said bottom panel of said utility bag is rested on said top surface of said carriage.

* * * * *